United States Patent [19]

Vehling

[11] Patent Number: 4,669,676

[45] Date of Patent: Jun. 2, 1987

[54] DEVICE FOR DEPOSITING CABLES

[75] Inventor: Ernst Vehling, Bordesholm, Fed. Rep. of Germany

[73] Assignee: Neumünstersche Maschinen-und Apparatebau GmbH (Neumag), Neumünster, Fed. Rep. of Germany

[21] Appl. No.: 840,644

[22] Filed: Mar. 17, 1986

[30] Foreign Application Priority Data

Mar. 29, 1985 [DE] Fed. Rep. of Germany ..... 3511560

[51] Int. Cl.[4] ..... B65H 51/20; B65H 54/82

[52] U.S. Cl. ..... 242/47; 242/47.12; 242/82; 242/83

[58] Field of Search ..... 242/47, 47.01, 47.08, 242/47.09, 47.1, 47.11, 47.12, 47.13, 82, 83

[56] References Cited

U.S. PATENT DOCUMENTS

| | | | |
|---|---|---|---|
| 1,851,252 | 3/1932 | Junkers | 242/47.13 |
| 2,691,852 | 10/1954 | Slayter et al. | 242/47.13 |
| 2,736,070 | 2/1956 | Drummond | 242/47.08 X |
| 2,742,737 | 4/1956 | McElroy | 242/47 X |
| 2,936,877 | 5/1960 | Adams et al. | 242/47.09 |
| 2,958,920 | 11/1960 | Erb | 242/47 |
| 3,469,796 | 9/1969 | Russell et al. | 242/47.13 |
| 3,683,650 | 8/1972 | Hirschburger | 242/47.12 |
| 4,304,366 | 12/1981 | Enneking et al. | 242/47 |

FOREIGN PATENT DOCUMENTS

| | | |
|---|---|---|
| 2741273 | 3/1978 | Fed. Rep. of Germany . |
| 1909738 | 5/1978 | Fed. Rep. of Germany . |
| 2809661 | 9/1979 | Fed. Rep. of Germany . |
| 2747706 | 5/1981 | Fed. Rep. of Germany . |
| 1134129 | 11/1956 | France . |

*Primary Examiner*—Stanley N. Gilreath
*Attorney, Agent, or Firm*—Michael J. Striker

[57] ABSTRACT

A device for depositing synthetic cables into individual containers comprises a tubular cable feeder feeding a cable into a non-rotating receiver which accommodates four cable-transporting organs which transport cable spirals in an axial direction. The cable transporting organs are each coupled to a main shaft of the device by a belt, a vertical drive shaft carrying a worm meshed with a worm gear supported on a horizontal shaft which carries a disc cooperating with a pressure roller for feeding a cable therebetween.

3 Claims, 8 Drawing Figures

DEVICE FOR DEPOSITING CABLES

BACKGROUND OF THE INVENTION

The present invention relates to a device for depositing cables made of synthetic fibers, in the form of spirals into receiving containers.

Cable-depositing devices for depositing cables into receiving containers or cans of the type under discussion include means for forming spirals while the cable is laid into the container. It is very important to avoid the formation of loops during the depositing of the cable into the containers and also on the conveying means guiding the cable into the container. If the cable is laid on in a non-regular shape it becomes troublesome to draw the cable out of the can. In order to obtain the most exact position of the cable within the container conventional devices for depositing cables have been provided with cable-feeding organs spaced at the periphery of a receiving or spiral-forming receiver. These cable-transporting organs have been formed as toothed or smooth discs or circular belts. The function of these cable-depositing organs is to form spirals or turns of cables while the cable is fed into the receiving container. The accommodation of the drives of these cable feeding organs within the device has presented a problem. For solving this problem one had to compromise at obtaining an efficient output in such devices or at limiting the application of the devices to certain cables. Specific difficulties have occurred while depositing tension-sensitive cable with a relatively low titer and with high speeds of depositing.

French patent FR-PS No. 11 34 129 (FIG. 5) discloses a device for depositing cables in which toothed discs are utilized as the cable feeding organs. The toothed discs are in mesh with a worm which is mounted on a main shaft of the device. This conventional device is, however, unsuitable for the majority of the cases of application. The usual number of revolutions of the main shaft is at the present time from 1,000 to 5,000 per minute. With such a speed, lubrication of the worm drive becomes indispensible. A lubrication agent would be adhered to the toothing of the discs and to the cable which is inserted immediately into the toothing, which would unavoidably lead to contamination of the cable. Moreover it has been difficult to meet the requirements existing for the teeth of such discs. On the one hand, the toothing of the disc must ensure sufficient operating characteristics of the worm drive and, on the other hand, the cable should be fed and deposited in a precise way and without damage and released into the receiving container. Any change in a feeding speed requires an exchange of the worm and the toothed discs and is possible only in a very narrow range.

Another cable depositing device has been disclosed in DE-PS No. 19 09 738. The above disadvantage is avoided in this device. The cable-feeding organs in these devices are four toothed discs which extend not in radial planes but are positioned—similarly to the wheels of the car—pairwise on the ends of two shafts. A worm gear is situated on each of the two shafts, which gear is in mesh with a worm mounted on the main shaft of the device. This known device which is adapted for depositing the cable to a conveyer belt has additional guide elements. The device, however is not suitable, due to a non-radial position of the toothed discs, for a proper formation of spiral cable turns and depositing the cable in the form of spirals into individual containers.

A further conventional device disclosed in DE-OS No. 2809 061 (FIG. 1) includes a plurality of endless belts operating as cable-feeding organs and each running over a drive roller and a deflection roller. The transmission drive is arranged laterally and below the cable receiver and has at the inlet side thereof a vertical shaft parallel to the axis of the system, which is coupled with the main shaft via the aforementioned belts. At the outlet side, the drive has a horizontal shaft which is connected to a drive roller of the cable-feeding organ via a further belt. The drive rollers of the remaining cable-feeding rollers must be driven by the aforementioned drive rollers via an elastic shaft ahd bevel gears or the like because sometimes it is impossible in a closed drive arrangement to couple all the drive rollers directly with the drive. Furthermore, this rather complex arrangement has also the disadvantage that the drive is positioned below the receiver, which leads to the increase in the height of the whole device and can make the depositing of the cable more difficult. When, for example a cable is deposited into a can or container which is rotated in a conventional fashion about an axis which is eccentrical to the axis of the system the cable spirals falling into the container at a certain speed, which can be drawn along with the rotating can, remain hanging below the structural components protruding downwardly.

The device for depositing cables disclosed in DE-AS No. 2747 706 has internal cable-feeding organs positioned at the periphery of the rotating receiver and also external cable-feeding organs which are arranged in a ring-shaped external body enclosing the receiver. The external cable-feeding organs are driven and drive the internal cable-feeding organs by a friction contact. The cable spirals run between the internal and external feeding organs and pressure is applied to these organs to generate a required friction force. This device however is not suitable for cables which are sensitive to squeezing.

The drive of the external feeding organs has not been disclosed in the above German reference. However, such a drive has been described in corresponding U.S. Pat. No. 4,304,366 as a bevel gear drive. The drive in this known device is arranged laterally and below the receiver whereby the insertion of the depositing device into the can and the formation of cable spirals is rather difficult.

The aforementioned DE-AS No. 2747 706 shows an embodiment in which the external cable-feeding organs are omitted. The cable is fed by the feeding organs formed by discs and is deposited below the axes of rotation of the discs so that, due to a pulling force, a torque is exerted on the discs whereby the latter are moved in rotation. In this embodiment, it is difficult to obtain a simultaneous feed. The device is unsuitable for tension-sensitive cables.

SUMMARY OF THE INVENTION

It is an object of the present invention to provide an improved device for depositing cables into individual containers.

It is a further object of the invention to provide a compact cable-depositing device with a drive suitable for operation with a high number of revolutions and which has a wide range of applications.

These and other objects of the invention are attained by a device for depositing cable of synthetic fibers in form of spirals into a cable receiving container, comprising a driven rotor having a substantially vertical axis; cable distributing means having an inlet coaxial with said axis and an outlet radially outwardly offset relative to said axis; a cable receiver for receiving the cable from said distributing means; a main shaft which is directed downwardly in said receiver and on which said receiver, connected to said rotor, is rotatably supported, said receiver being prevented from a joint rotation with said shaft; said receiver having a periphery and including a plurality of cable-transporting organs spaced from each other at said periphery and extending in vertical radial planes, each transporting organ being provided with a drive including a horizontal drive shaft carrying the transporting organ, a transmission shaft parallel to said main shaft and positioned in a space between adjacent cable-transporting organs, a first drive stage coupling said main shaft with said transmission shaft, and a second drive stage coupling said horizontal drive shaft with said transmission shaft, said second drive stage including a worm mounted on said transmission shaft and a worm gear meshing with said worm and mounted on said horizontal drive shaft.

Four cable transporting organs may be positioned in said receiver which are offset by 90° from each other, each two adjacent cable-transporting organs having a single transmission shaft carrying a single worm which is in mesh with two worm gears of both adjacent cable-transporting organs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
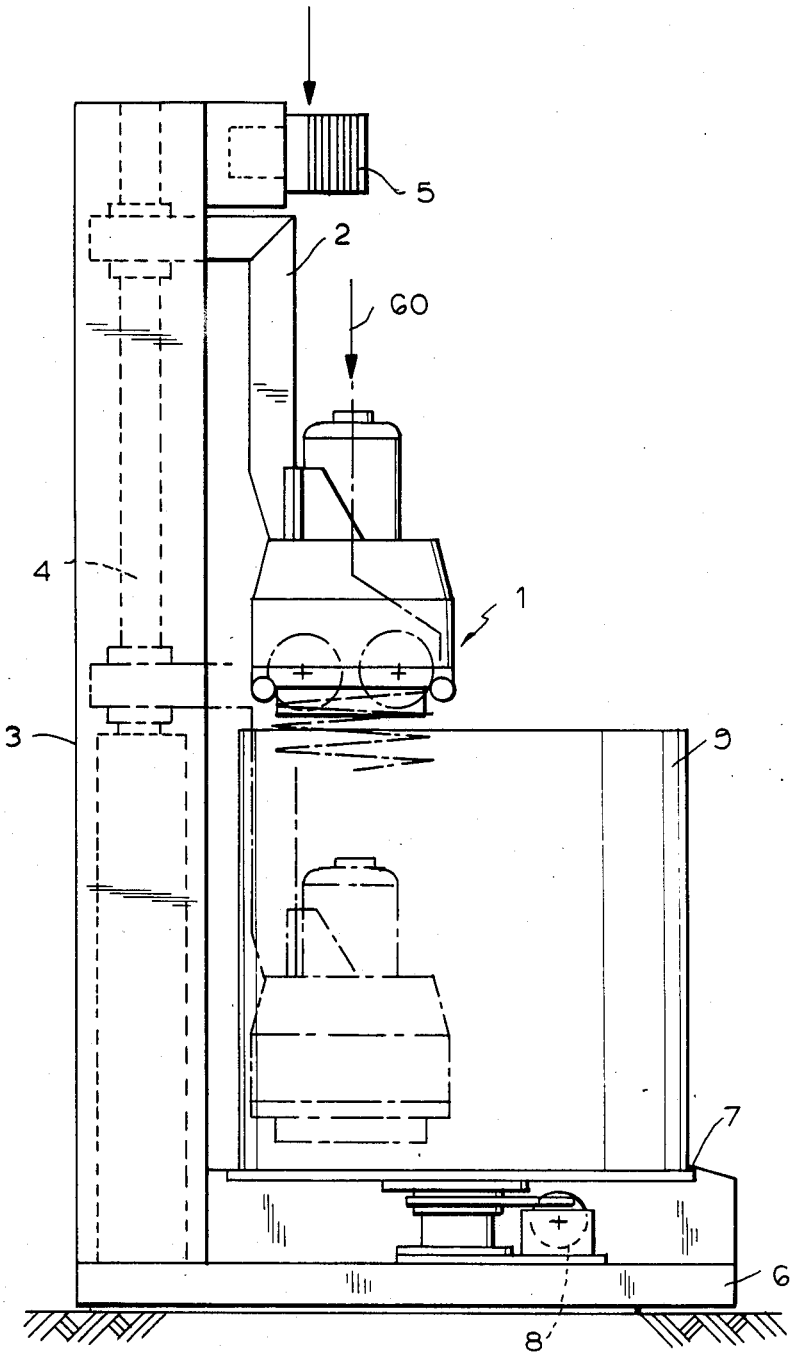
FIG. 1 is a schematically shown side view of the cable depositing device in the inserted position.

Referring now to the drawings in detail, and firstly to FIG. 1 thereof, it will be seen that a device for depositing a cable into a cable-receiving container or can is designated in toto by reference numeral 1. The cable depositing device 1 is substantially rotation-symmetrical and its vertical geometric axis is named hereinafter as system axis. A downwardly projecting or angled arm 2 is secured to depositing device 1. Arm 2 is mounted in a machine frame 3 and connected therein with a vertical lifting device 4 which can be actuated by a threaded spindle or any conventional hydraulic or pneumatic drive. A cable supplying or galette device 5 is disposed on the machine frame 3 above the cable depositing device 1. The machine frame 3 has a base plate 6 to which a rotation disc 7 is, connected which can be set in rotation about its axis eccentrical to the system axis by means of a motor 8 and a transmission. A container or can 9 of approximately the same diameter as that of the rotation disc 7 is positioned on the latter.

Figure 2:
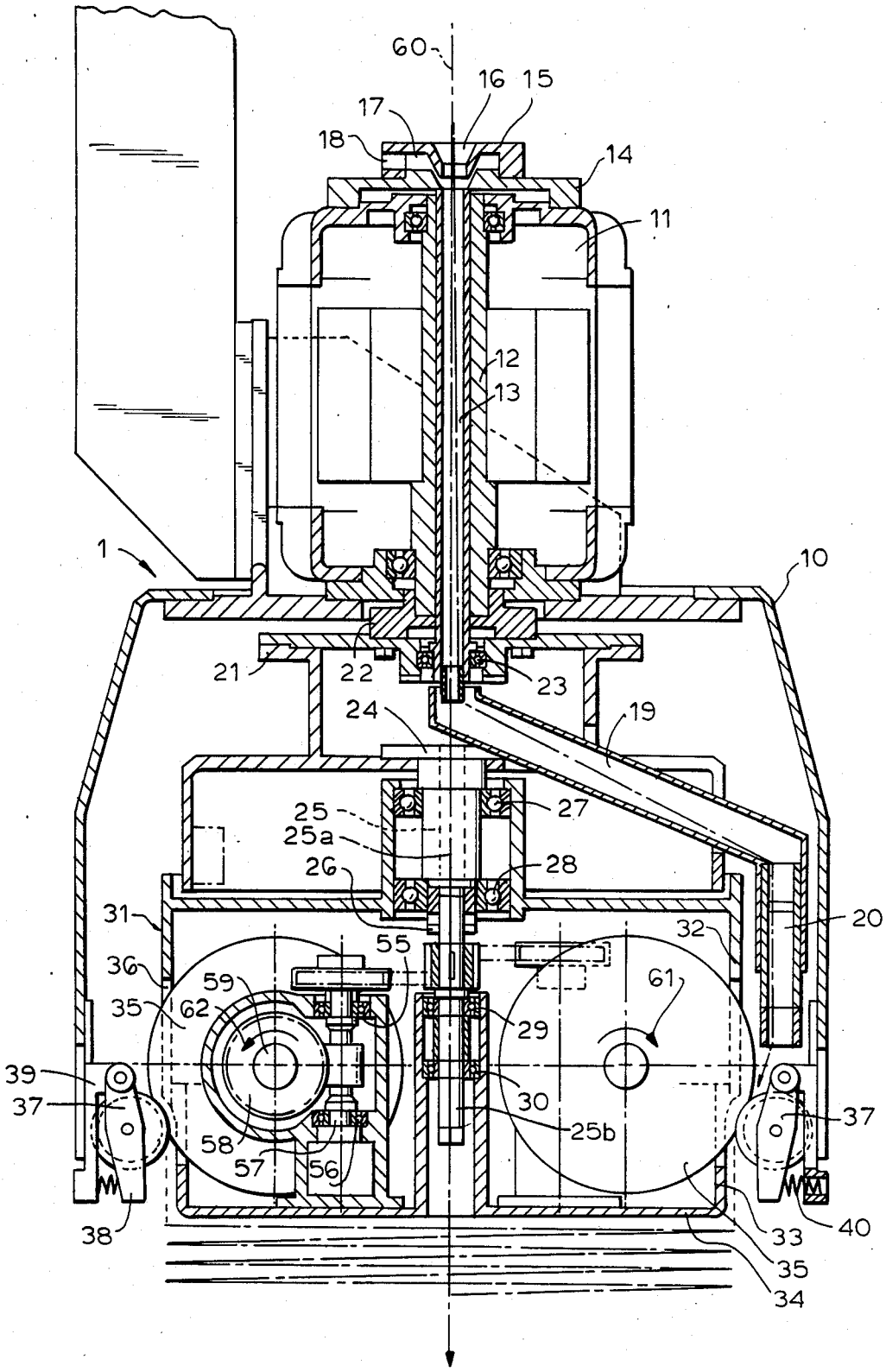
FIG. 2 is an axial sectional view of the cable depositing device of the invention.

With reference to FIG. 2 it will be seen that the cable depositing device 1 has a downwardly open hood 10 which is rigidly connected to arm 2 which is not shown in FIG. 2. Above the hood 10 and on the latter, is positioned a motor 11 with a hollow shaft 12 the geometric axis of which coincides with the system axis. Coaxially with hollow shaft 12 extends a tube 13 which projects through the whole shaft 12 and has its upper end fixedly connected to a head plate 14 screwed to the upper side of the motor 11.

A nozzle plate 15 is situated on the head plate 14. An inlet opening 16 of the nozzle plate 15 opens into the tube 13. The inlet opening 16 is concentrically surrounded with an annular passage 17 which has a pressure air connection 18 and is also in connection with the interior of the tube 13 via a ring-nozzle-like narrow clearance.

The elongated lower end of tube 13 opens into a tube 19 which is oblique and extends downwardly in the direction of the peripheral surface of the hood 10 and has in the proximity of this hood a projection 20 bent downwardly. The tubular cable feeder is thus comprised of elements 13, 19 and 20. Tube 19 is rigidly secured to a rotor 21 which is screwed to a flange 22 situated on the hollow shaft 12. Rotor 21 is rotatable relative to the tube 13 via a ball bearing 23. A flange 24 receives a main shaft 25 which is rotatable about the system axis. Main shaft 25 which extends downwardly of the flange 24 is rigidly connected, by means of this flange, to the rotor 21. The main shaft 25 is comprised, for construction reasons, of two shaft portions **25*a* and 25*b* connected to each other by a plug-in coupling 26. A substantially cylindrical receiving body 31 is positioned on the main shaft 25 by means of ball bearings 27, 28, 29 and 30. The peripheral wall of the receiving body 31 is comprised of an upper portion 32 and a lower portion 33 releasably insertable into the upper portion and having a diameter somewhat smaller than that of the upper portion. A bottom 34 connected with the lower portion 33 is positioned only somewhat below the lower rim of the hood 10. Four circular discs 35 forming a transporting organ are positioned in the interior of the receiving body 31. These discs are disposed in vertical planes which are radially offset by 90° relative to each other with respect to the system axis. The diameter of each disc 35 is insignificantly smaller than a radius of the receiving body 31 and coincides, provided with a required play, with the height of the receiving body 31. Each disc 35 extends outwardly with a small segment from the peripheral wall of the receiving body 31 through a slot 36 formed in the wall portions 32, 33. Discs 35 are rotatable about a horizontal axis by means of a drive which will be explained herein below. The horizontal axis of rotation of discs 35 is positioned somewhat below the plane of opening of the tubular projection or extension 20**.

Figure 3:
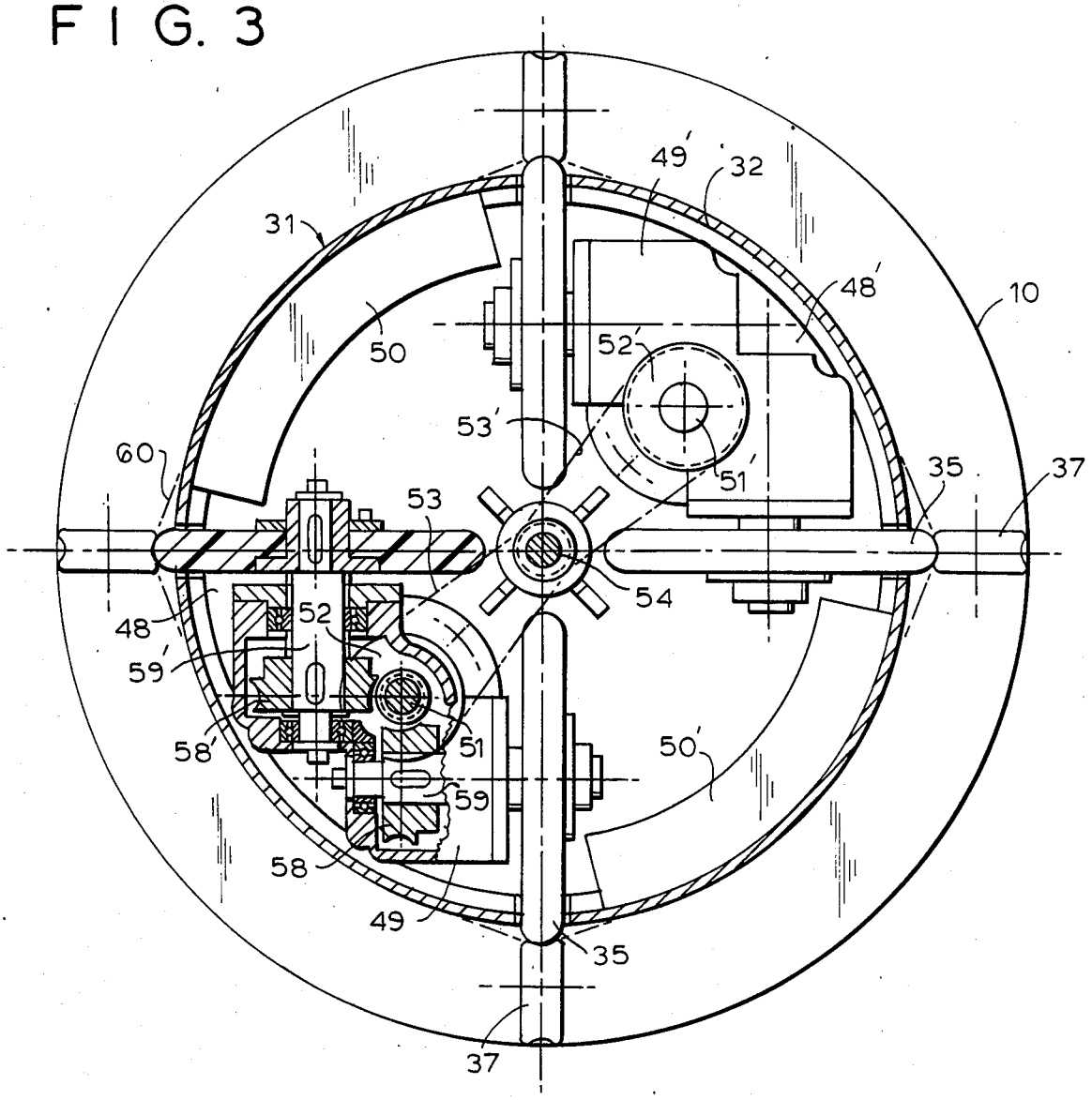
FIG. 3 is a horizontal sectional view of the device of FIG. 2.
Figure 4:
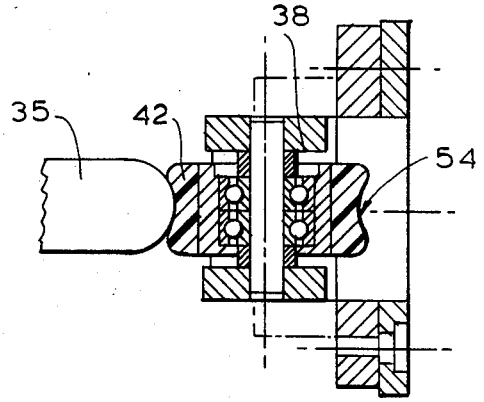
FIG. 4 is a horizontal view, partially in section, of the single conveying unit according to a first embodiment.

In the embodiment illustrated in FIGS. 2 through 4, the discs are spherical at their periphery as clearly shown in FIGS. 3 and 4. Each disc 35 is assigned to a pressure roller 37. The pressure rollers are loosely rotated on rocking arms 38. Each rocking arm 38 is pivoted at its upper end to a yoke 39 (FIG. 2) which is secured somewhat at the level of the axis of disc 35 to the inner wall of the hood 10. A spring 40 presses against the free lower end of the rocking arm 38, which spring is supported at the lower rim of hood 10. The compressing force of spring 40 is adjustable by means of a screw 41. The ratio between the diameters of the pressure roller 37 and the disc 35 is about 1:3. The point of contact between the pressure roller 37 and disc 35 lies below the axis of disc 35 at a distance which corresponds to about a half of the disc radius. The pressure rollers 37 have at their peripheries thick rubber layers 42 which have an outer curved surface matching the spherical outer periphery of the discs 35.

Figure 5:
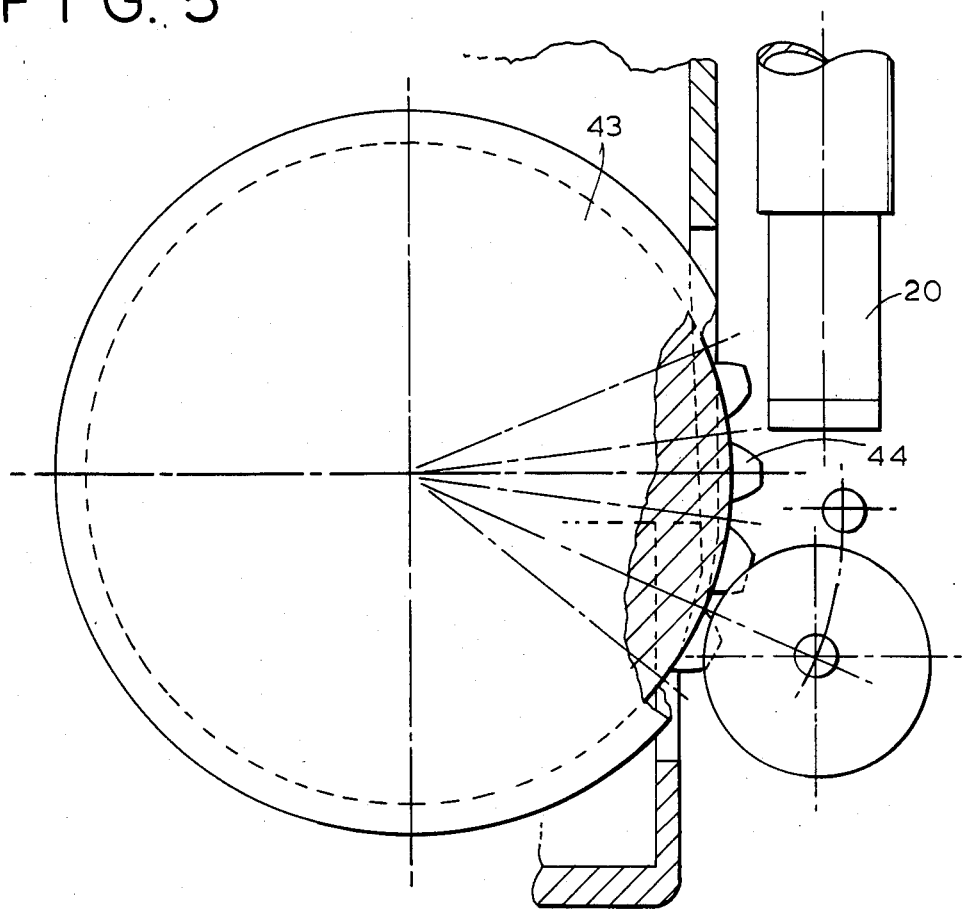
FIG. 5 is a side view, partially in section, of the unit according to a modified embodiment.
Figure 6:
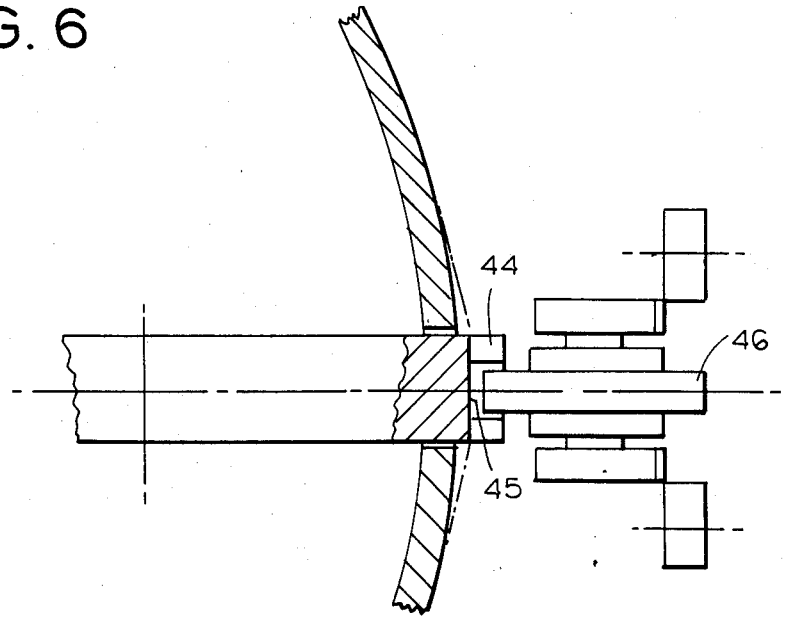
FIG. 6 is a horizontal view, partially in section, of the unit of FIG. 5.

In the embodiment shown in FIGS. 5 and 6, toothed discs 43 are utilized as a cable transporting organ. The peripheral toothing 44 provided on discs 43 is interrupted by a circular groove 45. Counter rollers 46 are engaged in grooves 45 of the respective discs 43. Each counter roller 46 is arranged similarly to the pressure roller 37 of the previously described embodiment. The counter rollers 46 can be urged by a spring force to the base of the groove 45. These counter rollers can also be adjusted in position by simple adjusting screws at a predetermined distance from the discs, as shown in FIG. 2. In the position illustrated in FIG. 6, particularly for depositing cables made of squeeze-sensitive material, pressure or counter rollers 46 are engaged in grooves 45 without contacting the cable being conveyed.

Figure 7:
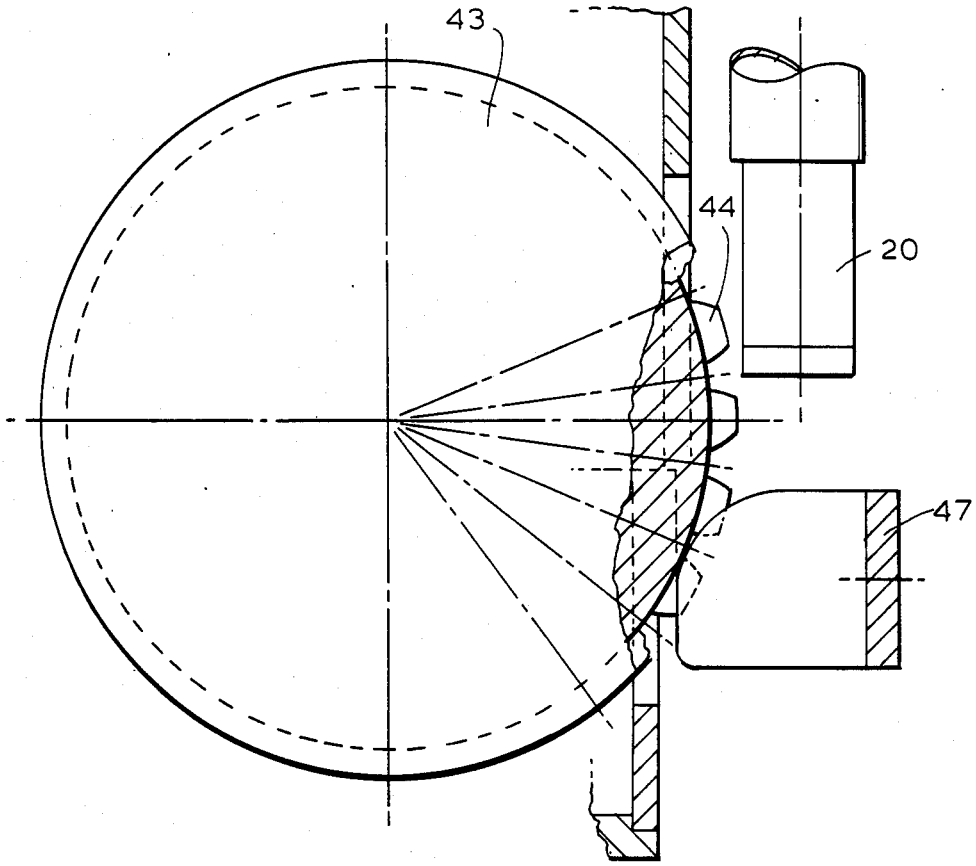
FIG. 7 is a side view of the conveying unit of yet another embodiment.

In the embodiment shown in FIG. 7, in place of the counter roller 46, a stationary yoke 47 is provided, which is engaged in the groove 45 without, however, reaching or contacting the base of this groove. It is sufficient in simple instances to provide only a single yoke which engages in the groove of one of the toothed discs 43.

The transporting organ, namely discs 35 or toothed discs 43 are coupled to the main shaft 25.

A drive for the cable-transporting organs is completely accommodated in the receiving body 31, without however requiring that the size of this receiving body be enlarged. In the embodiment shown in the drawings only two out of four vertically positioned sectors between the transporting organs are sufficient for accommodation of the drive. These sectors designated by reference numerals 48, 48′ are positioned opposite to each other relative to the system axis. An angular oil-tightly sealed bearing housing 49, 49′ is positioned in each sector 48, 48′. Both remaining sectors are used for accommodating easily accessible connection organs 50. In each of the two bearing housings or blocks 49, 49′, a drive shaft 51, 51′ parallel to the main shaft 25 is positioned. Both drive shafts are offset relative to each other by 180° in respect to the system axis. Toothed gears 52, 52′ are situated on the ends of the drive shafts 51, 51′ extended outwardly from the bearing housings 49, 49′. Gears 52, 52′ are coupled, by means of toothed belts 53, 53′ to a toothed sleeve 54 which is connected to the main shaft 25. The toothed belt 53 is wrapped around the upper portion of the sleeve 54 while the toothed belt 53 is wrapped around the lower portion of the sleeve. The toothed belt drive 52, 53, 54 or 52′, 53′, 54′ form a first drive stage. A second drive stage is formed by a worm gear drive positioned in each bearing housing 49, 49′. Only one worm gear drive, positioned in the bearing housing 49 is shown in FIGS. 3 and 4. This drive includes a worm 57 (FIG. 2) situated on the drive shaft 51 between ball bearings 55, 56 by means of which shaft 51 is supported in the bearing housing 49. Two worm gears 58, 58′ are in mesh with the worm 57. The worm gears 58, 58′ are positioned on drive shafts 59, 59′ between the discs 35 which enclose sector 48. The drive shafts 59, 59′ are supported in the bearing housing 49.

The second drive stage for both discs which enclose the sector 48′ is entirely the same as that described for sector 48.

Discs 35 and various drive structural components are easily releasably-connected to the respective shafts so that an exchange of any structural component can be performed in short time.

The above described embodiments are suitable for depositing cables of relatively low titer between 500 and 5000 dtex, which cables are pulled with speeds from 1000 to 5000 m/min and are deposited into containers whereby cable strains are maintained below 1 g/dtex.

The mode of operation of the device for depositing cables into container is as follows:

A cable 60 is guided through the gallette 5 substantially along the system axis. Upon the insertion of the cable into the device 1, the connection 18 is loaded with pressure air. During continuous operation, the pressure air is shut off. Alternatively, for leading off an electrostatic charge during continuous operation air with a small overpressure from 0.1 to 0.5 bar and high relative moisture can be fed into the device. The rotor 21 is rigidly connected with the tubular cable feeding device 13, 19, 20 and rotates therewith with high number of revolutions. The cable discharged from the lower end of the vertical tubular extension 20 is deposited onto the non-rotating receiving body 31. Discs 35 which are coupled to the rotated main shaft 25 rotate slowly in the direction of arrows 61, 62, that is so that the segments of the discs, extended outwardly from the peripheral wall of the receiving body 31 define a substantially downwardly directed transporting movement. The deposited cable turns positioned slightly above the axes of the discs are firstly slightly prestressed and are taken along by discs 35 in the downward direction and fed between discs 35 and the assigned pressure rollers 37. The latter have a double function. Due to a locking-type engagement of the pressure roller 37 with the spherical peripheral surfaces of the discs 35 the joint rotation of the receiving container is prevented. Furthermore, each turn of the cable desposited on the surface of the receiving body is not released before passing the point of contact between the discs 35 and pressure roller 37. The lower portion 33 of the receiving body serves as a guide for falling cable spirals and prevents an undesired loop deformation. Due to a reduced diameter no friction forces are exerted on the falling cable spirals.

Figure 8:
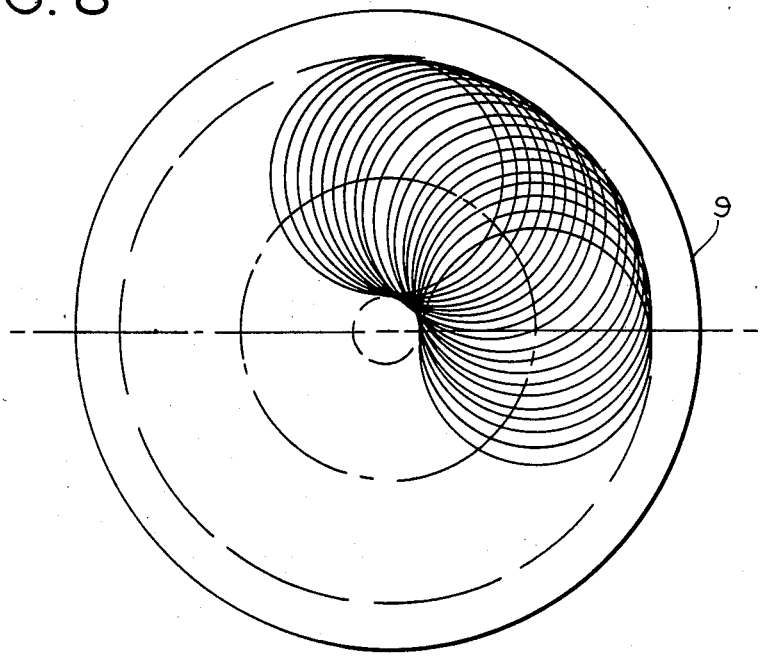
FIG. 8 is a schematic view of spiral turns of the cable deposited in the container.

Individual cable spirals fall into the container 9 which is rotated about its axis by the rotation disc 7. The cable turns form in the container 7 a pattern shown in FIG. 8. In order to enable an exact distribution of the cable spirals in the container a free falling height must be maintained low. For this purpose, when operation begins depositing device 1 is in the position shown by dashed lines in FIG. 1. The lifting device 4 continually moves the depositing device during the advanced filling upwardly so that the bottom 34 of the receiving body 31 is continually close-fitted above the uppermost filling layer. So it is possible to obtain a loose filling which ensures that the cable can be drawn out of the container without trouble.

EXAMPLE

A cable of 100 dtex is fed with tension of 0.5 g/dtex and speed of 3000 m/min. The peripheral dimension of the receiving body 31 is about 1 m. The receiving body rotates with the number of revolutions of 3000 u/min. Discs 35 rotate with the number of revolutions 100 U/min. The periphery of each disc is 40 cm. The conveying speed of each disc in the downward direction is 40 m/min. The distance between the adjacent spirals of cable is 1.32 cm.

In the embodiments according to FIGS. 5 to 7, in which the joint rotation of the receiving container 31 is prevented by counter rollers 46 engaged in the grooves 45 or by yokes 47, the number of revolutions of the toothed discs 43 must be adjusted to the number of teeth so that the cable spirals would be exactly inserted into the tooth gaps.

EXAMPLE

The speed of feeding of the cable is again 3000 m/min. The pheripheral size of the receiving body 31 is 1 m and its number of revolutions is 3000 U/min. The distance between two adjacent tooth gaps is 1 cm, the tooth number is 40, the periphery of each disc is 40 cm. In order to deposit 3000 spirals of cable per minute the peripheral speed of the toothed discs must be 30 m/min. Thus the number of revolutions for each disc 43 is 75 U/min. The drive is laid out respectively, depending on the dimensions.

It will be understoood that each of the elements described above, or two or more together, may also find a useful application in other types of devices for depositing cables into containers differing from the types described above.

While the invention has been illustrated and described as embodied in a device for depositing cable turns into a container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for depositing cables of synthetic fibers in form of spirals into a cable receiving container, comprising a driven motor having a substantially vertical axis; cable distributing means having an inlet coaxial with said axis and an output radially outwardly offset relative to said axis; a cable receiver for receiving the cable from said distributing means; a main shaft connected to said rotor and driven thereby, said main shaft being directed downwardly in said receiver and being rotatably supported therein while said receiver is prevented from joint rotation with said shaft; said receiver having a periphery and accommodating a plurality of cable-transporting organs spaced from each other at said periphery and extending in vertical radial planes, each transporting organ being provided with a drive, each drive including a first horizontal drive shaft (59, 59') carrying the transporting organ, a second drive shaft (51, 51') extending parallel to said main shaft, a first drive stage coupling said main shaft with said second drive shaft and a second drive stage coupling each first horizontal drive shaft with said second drive shaft to drive said transporting organ, said second drive stage including a worm mounted on said second drive shaft and a worm gear meshing with said worm and mounted on said first horizontal drive shaft.

2. The device as defined in claim 1, wherein said first drive stage includes a toothed belt coupling said main shaft and said second drive shaft to each other.

3. The device as defined in claim 1, wherein four cable-transporting organs are positioned in said receiver, which are offset by 90° from each other, each two adjacent cable-transporting organs having a common second drive shaft carrying a common worm which is in mesh with two worm gears of two adjacent cable-transporting organs.

* * * * *